US005215067A

United States Patent [19]

Shimasaki et al.

[11] Patent Number: 5,215,067

[45] Date of Patent: Jun. 1, 1993

[54] MISFIRE-DETECTING SYSTEM FOR INTERNAL COMBUSTION ENGINES

[75] Inventors: Yuuichi Shimasaki; Masaki Kanehiro; Takuji Ishioka; Takashi Hisaki; Shigeru Maruyama; Masataka Chikamatsu; Shigetaka Kuroda; Hideaki Arai; Shigeki Baba, all of Wako, Japan

[73] Assignee: Honda Giken Koygo Kabushiki Kaisha, Tokyo, Japan

[21] Appl. No.: 846,238

[22] Filed: Mar. 5, 1992

[30] Foreign Application Priority Data

Mar. 7, 1991 [JP] Japan ..... 3-67940
Nov. 14, 1991 [JP] Japan ..... 3-326507

[51] Int. Cl.[5] ..... F02P 11/00; F02P 17/00

[52] U.S. Cl. ..... 123/630; 324/388; 324/399

[58] Field of Search ..... 123/198 F, 479, 481, 123/630; 324/378, 380, 388, 399; 73/117.3

[56] References Cited

U.S. PATENT DOCUMENTS 3,942,102 3/1976 Kuhn et al. ..... 324/399
3,961,240 6/1976 Pohl ..... 324/399
4,117,807 10/1978 Barnard ..... 123/478
4,327,310 4/1982 Jorg ..... 315/209 R
4,366,794 1/1983 Hachiga et al. ..... 123/198 DB X
4,454,560 6/1984 Nakao et al. ..... 361/257
4,825,167 4/1989 Bayba ..... 324/399
4,886,029 12/1989 Lill et al. ..... 123/630 X
4,918,389 4/1990 Schleupen et al. ..... 123/630 X
4,969,443 11/1990 DeBiasi ..... 123/630 X
5,017,874 5/1991 Di Nunzio et al. ..... 324/378
5,019,779 5/1991 Ookawa ..... 324/388
5,046,470 9/1991 Entenmann et al. ..... 123/630 X

FOREIGN PATENT DOCUMENTS 51-22568 7/1976 Japan .

*Primary Examiner*—Tony M. Argenbright
*Attorney, Agent, or Firm*—Nikaido, Marmelstein, Murray & Oram

[57] ABSTRACT

A misfire-detecting system detects a misfire occurring in an internal combustion engine. A value of sparking voltage after generation of an ignition command signal indicative of ignition timing is detected and compared with a predetermined voltage value, and it is determines based upon the results of the comparison whether or not a misfire has occurred in the engine. The determination as to occurrence of the misfire is based upon at least one of a time period over which the detected value of the sparking voltage exceeds the predetermined voltage value, and an area of a portion of detected values of the sparking voltage exceeding the predetermined voltage value.

8 Claims, 14 Drawing Sheets

MISFIRE-DETECTING SYSTEM FOR INTERNAL COMBUSTION ENGINES

BACKGROUND OF THE INVENTION

1. Field of the Invention

This invention relates to a misfire-detecting system for internal combustion engines, and more particularly to a misfire-detecting system which is capable of detecting a misfire attributable to the fuel supply system.

2. Prior Art

In an internal combustion engine in general, high voltage (sparking voltage) generated by the ignition coil of the engine is sequentially distributed to the spark plugs of the cylinders of the engine via a distributor, to ignite a mixture supplied to the combustion chambers. If normal ignition does not take place at one or more of the spark plugs, i.e. a misfire occurs, it will result in various inconveniences such as degraded driveability and increased fuel consumption. Furthermore, it can also result in so-called after-burning of unburnt fuel gas in the exhaust system of the engine, causing an increase in the temperature of a catalyst of an exhaust gas-purifying device arranged in the exhaust system. Therefore, it is essential to prevent occurrence of a misfire. Misfires are largely classified into ones attributable to the fuel supply system and ones attributable to the ignition system. Misfires attributable to the fuel supply system are caused by the supply of a lean mixture or a rich mixture to the engine, while misfires attributable to the ignition system are caused by failure to spark (so-called missparking), i.e. normal spark discharge does not take place at the spark plug, due to smoking or wetting of the spark plug with fuel, particularly adhesion of carbon in the fuel to the spark plug, which causes current leakage between the electrodes of the spark plug, or an abnormality in the ignition circuit.

A conventional misfire-detecting system is already known from Japanese Patent Publication (Kokoku) No. 51-22568, which utilizes the fact that the frequency of damping oscillation voltage generated in a primary circuit of an ignition device whenever the contacts of the distributor are opened is higher when a spark ignition occurs than when failure to spark occurs.

However, the conventional misfire-detecting system is only based upon the frequency of damping oscillation voltage generated in the ignition circuit, i.e. based upon whether or not a discharge occurs between the electrodes of the spark plug. Therefore, the conventional system is unable to discriminate whether a misfire detected is attributable to a cause in the fuel supply system such that although a discharge has actually occurred, the mixture is not fired due to its lean or rich state, or to a cause in the ignition system, thus failing to take a satisfactory and prompt fail-safe action.

SUMMARY OF THE INVENTION

It is the object of the invention to provide a misfire-detecting system for internal combustion engines, which is capable of accurately detecting a misfire attributable to the fuel supply system.

To attain the above object, the present invention provides a misfire-detecting system for detecting a misfire occurring in an internal combustion engine having an ignition system including at least one spark plug, engine operating condition-detecting device for detecting values of operating parameters of the engine, signal-generating device for determining ignition timing of the engine, based upon the detected values of the operating parameters of the engine and generating an ignition command signal indicative of the determined ignition timing, and igniting device responsive to the ignition command signal for generating sparking voltage for discharging the at least one spark plug.

The misfire-detecting system according to the invention is characterized by comprising:

voltage value-detecting device for detecting a value of the sparking voltage generated by the igniting device after generation of the ignition command signal; and misfire-determining device for comparing the detected value of the sparking voltage with a predetermined voltage value, and determining whether or not a misfire has occurred in the engine, based upon results of the comparison;

the misfire-determining device effects the determination as to occurrence of the misfire, based upon at least one of a time period over which the detected value of the sparking voltage exceeds the predetermined voltage value, and a value proportional to an area of a portion of detected voltage values of the sparking voltage exceeding the predetermined voltage value.

The predetermined voltage value is set in dependence on operating conditions of the engine.

Preferably, the misfire-determining means includes reference level-setting device which sets the predetermined voltage value based upon the detected value of the sparking voltage.

More preferably, the reference level-setting device comprises smoothing device for smoothing the sparking voltage, and amplifier device for amplifying an output from the smoothing device by a predetermined amplification factor.

Further preferably, the igniting device has a primary circuit and a secondary circuit, the misfire-detecting system including current-checking device arranged in the secondary circuit for checking a flow of current in a reverse direction to a direction in which a current flow occurs at discharge of the at least one spark plug.

Preferably, the ignition coil comprises a primary coil and a secondary coil, the sparking voltage being primary voltage generated by the primary coil.

Alternatively, the ignition coil comprises a primary coil and a secondary coil, the sparking voltage being secondary voltage generated by the secondary coil.

Specifically, the engine has a fuel supply system, the misfire being attributable to the fuel supply system.

The above and other objects, features, and advantages of the invention will become more apparent from the following detailed description taken in conjunction with the accompanying drawings.

DETAILED DESCRIPTION

The invention will now be described in detail with reference to the drawings showing embodiments thereof.

Figure 1:
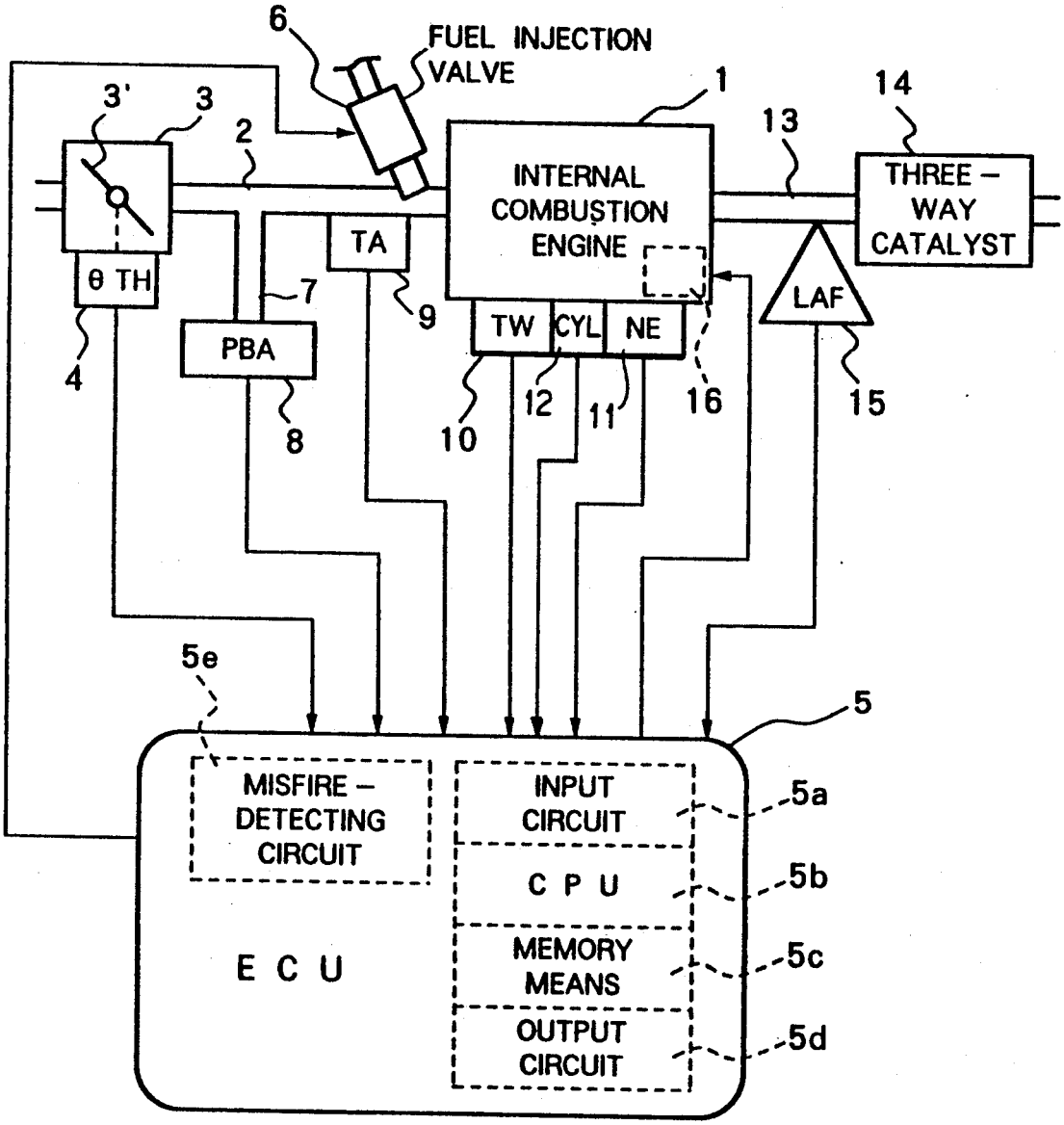
FIG. 1 is a block diagram showing the whole arrangement of an internal combustion engine incorporating a misfire-detecting system according to the invention.

Referring first to FIG. 1, there is shown the whole arrangement of an internal combustion engine incorporating a misfire-detecting system according to the invention. In an intake pipe 2 of an engine 1, there is arranged a throttle body 3 accommodating a throttle valve 3' therein. A throttle valve opening ($\theta$TH) sensor 4 is connected to the throttle valve 3' for generating an electric signal indicative of the sensed throttle valve opening and supplying the same to an electronic control unit (hereinafter referred to as "the ECU") 5.

Fuel injection valves 6 are each provided for each cylinder and arranged in the intake pipe at a location between the engine 1 and the throttle valve 3' and slightly upstream of an intake valve, not shown. The fuel injection valves 6 are connected to a fuel pump, not shown, and electrically connected to the ECU 5 to have their valve opening periods controlled by signals therefrom.

On the other hand, an intake pipe absolute pressure (PBA) sensor 8 is provided in communication with the interior of the intake pipe 2 via a conduit 7 at a location immediately downstream of the throttle valve 3' for supplying an electric signal indicative of the sensed absolute pressure to the ECU 5. An intake air temperature (TA) sensor 9 is inserted into the intake pipe 2 at a location downstream of the intake pipe absolute pressure sensor 8 for supplying an electric signal indicative of the sensed intake air temperature TA to the ECU 5.

An engine coolant temperature (TW) sensor 10, which may be formed of a thermistor or the like, is mounted in the cylinder block of the engine 1 for supplying an electric signal indicative of the sensed engine coolant temperature TW to the ECU 5. An engine rotational speed (NE) sensor 11 and a cylinder-discriminating (CYL) sensor 12 are arranged in facing relation to a camshaft or a crankshaft of the engine 1, neither of which is shown. The engine rotational speed sensor 11 generates a pulse as a TDC signal pulse at each of predetermined crank angles whenever the crankshaft rotates through 180 degrees, while the cylinder-discriminating sensor 12 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious components such as HC, CO and $NO_X$. An $O_2$ sensor 15 as an exhaust gas ingredient concentration sensor (referred to hereinafter as an "LAF sensor") is mounted in the exhaust pipe 13 at a location upstream of the three-way catalyst 14, for supplying an electric signal having a level approximately proportional to the oxygen concentration in the exhaust gases to the 1CU 5.

Further, an ignition device 16, which comprises an ignition coil, and spark plugs, hereinafter referred to, is provided in the engine 1 and controlled to effect spark ignition by an ignition command signal A from the ECU 5.

The ECU 5 comprises an input circuit 5*a* having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as "the CPU") 5*b*, memory means 5*c* storing various operational programs which are executed by the CPU 5*b* and for storing results of calculations therefrom, etc., an output circuit 5*d* which outputs driving signals and the ignition command signal A to the fuel injection valves 6 and the ignition device 16, respectively, and a misfire-detecting circuit 5*e*, hereinafter described.

The CPU 5*b* operates in response to the above-mentioned signals from the sensors to determine operating conditions in which the engine 1 is operating such as an air-fuel ratio feedback control region and open-loop control regions, and calculates, based upon the determined engine operating conditions, the valve opening period or fuel injection period $T_{OUT}$ over which the fuel injection valves 6 are to be opened in synchronism with inputting of TDC signal pulses to the ECU 5.

Further, the CPU 5*b* calculates the ignition timing TIG of the engine, based upon the determined engine operating condition.

The CPU 5*b* performs calculations as described hereinbefore, and supplies the fuel injection valves 6 and the ignition device 16, respectively, with driving signals and the ignition command signal A based on the calculation results through the output circuit 5.

Figure 2:
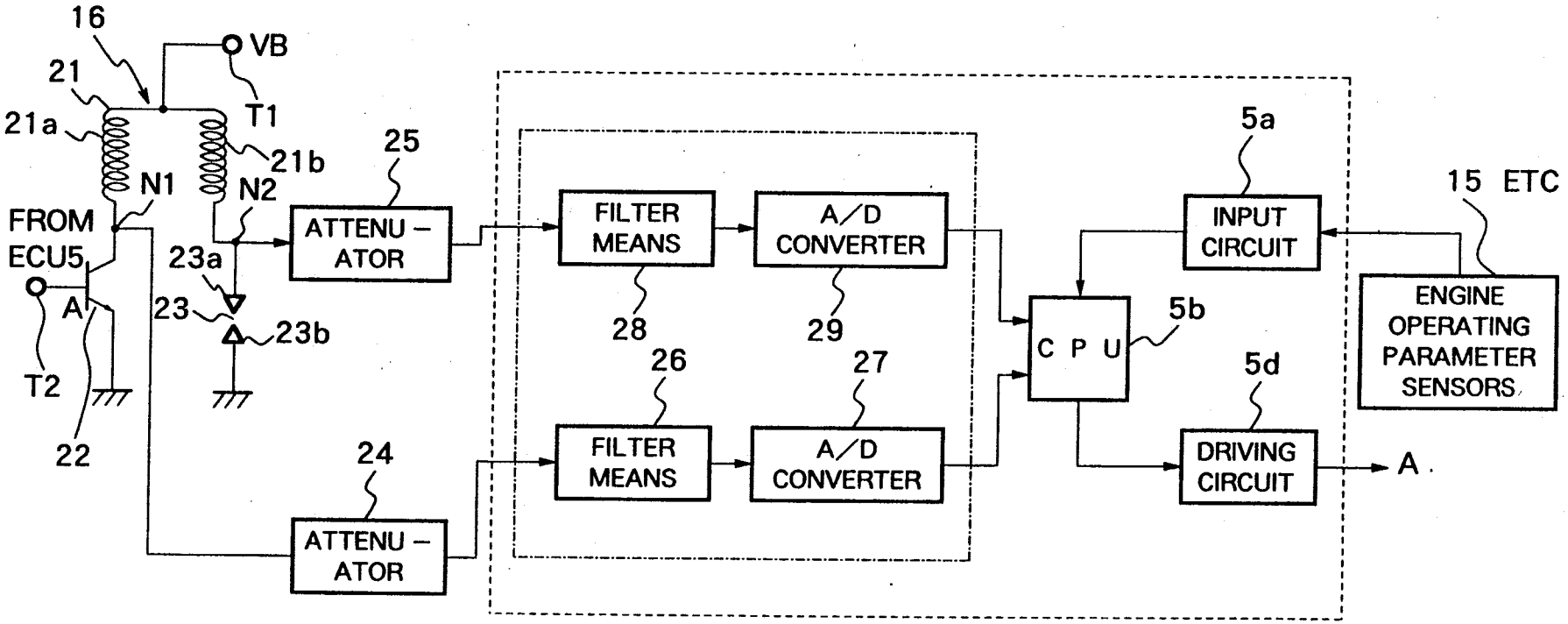
FIG. 2 is a block diagram showing a misfire-detecting system for an internal combustion engine according to a first embodiment of the invention.

FIG. 2 shows the arrangement of the misfire-detecting system according to a first embodiment of the invention. The misfire-detecting system according to this embodiment is adapted to detect whether or not a misfire has occurred and also whether or not the misfire is attributable to the fuel supply system, from the magnitude of capacitive discharge voltage generated by discharging of the spark plug.

In FIG. 2, the ignition device 16 is constructed such that a feeding terminal T1, which is supplied with supply voltage VB, is connected to an ignition coil (igniting means) 21 comprised of a primary coil 21*a* and a secondary coil 21*b*. The primary and secondary coils 21*a*, 21*b* are connected with each other at one ends thereof. The other end of the primary coil 2 is connected to a collector of a transistor 22 by way of a node N1 at which sparking voltage (primary voltage) is generated. The transistor 22 has its base connected to an input terminal T2 which is supplied with the ignition command signal A and its emitter grounded. The other end of the secondary coil 21*b* is connected to a center electrode 23*a* of a spark plug 23 of each engine cylinder by way of a node N2 at which sparking voltage (secondary voltage) is generated. The spark plug 23 has its ground electrode 23*b* grounded. The node N1 is connected to an input of an attenuator (voltage value-detecting means) 24, while the node N2 is connected to an input of another attenuator (voltage value-detecting means) 25. The attenuators 24, 25 have their outputs connected to processing unit the CPU 5*b* by way of filter means 26, 28 and A/D convertors 27, 29 of the ECU 5. The attenuators 24, 25 are voltage-dividing means which divide the primary and secondary voltages with respective predetermined ratios of 1/1000 and 1/100, respectively, so that the primary voltage is changed from several hundreds volts to several volts, and the secondary voltage from several tens kilovolts to several tens volts. The CPU 5*b* is connected to the base of the transistor 22 by way of the output circuit 5*d*, which is supplied with the ignition command signal A, and also connected via the input circuit 5*a* to various engine operating parameter sensors (engine operating condition-detecting means) including the NE sensor 15 and the PBA sensor 8. The CPU 5*b* forms signal-generating means which determines the ignition timing based upon engine operating conditions and generates the ignition command signal A, and misfire-determining means which determines whether or not a misfire attributable to the fuel supply system has occurred.

Figure 4:
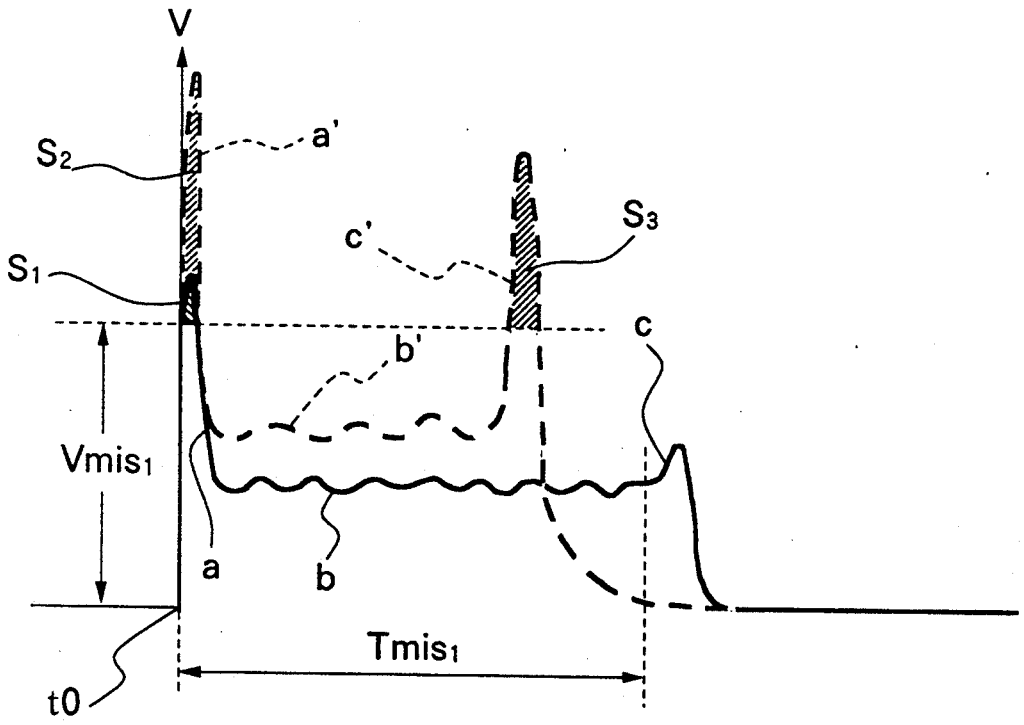
FIG. 4 is a timing chart showing changes in the primary voltage, useful in explaining a misfire attributable to the fuel supply system.
Figure 6:
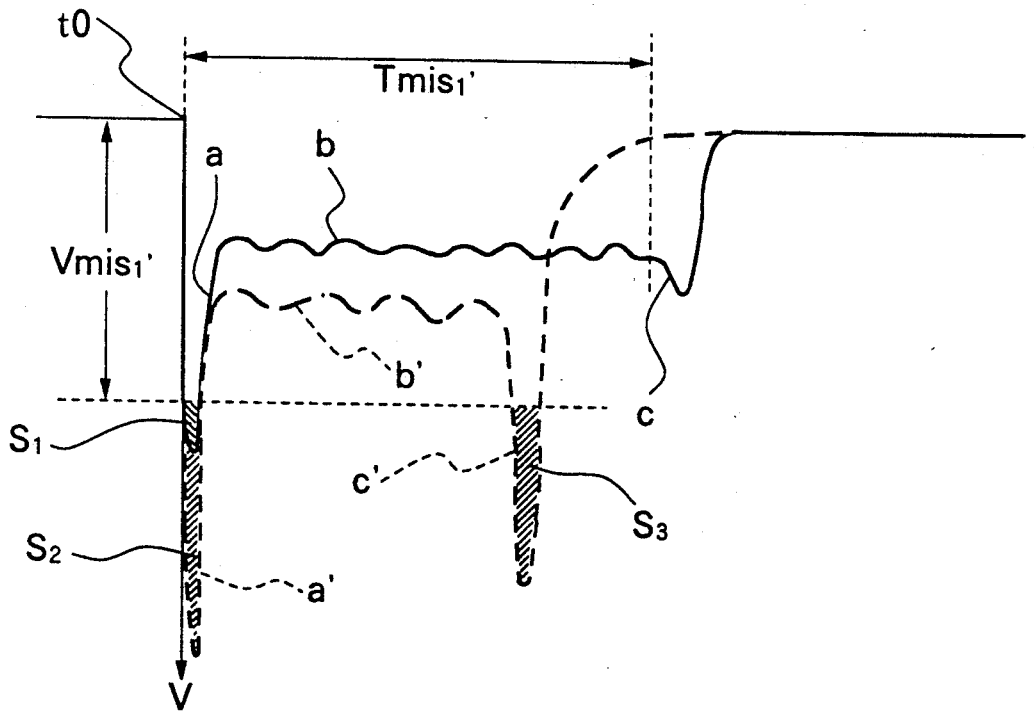
FIG. 6 is a timing chart showing changes in the secondary voltage, useful in explaining a misfire attributable to the fuel supply system.

FIGS. 4 and 6 are timing charts showing, respectively, sparking voltage (primary voltage) generated by the primary coil 21*a* of the ignition coil 21, and sparking voltage (secondary voltage) generated by the secondary coil 21*b*, the voltages being generated in response to the ignition command signal A.

These figures are useful in explaining misfires attributable to the fuel supply system. In each of FIGS. 4 and 6, the solid line indicates a sparking voltage obtained when the mixture is normally fired, and the broken line a sparking voltage obtained when a misfire occurs.

Sparking voltage characteristics obtainable in the above respective cases will now be explained with reference to FIG. 4.

First, a sparking voltage characteristic obtainable in the case of normal firing will be explained, which is indicated by the solid line. Suppose that immediately after a time point tO the ignition command signal A is generated. Then, sparking voltage rises to such a level as to cause dielectric breakdown of the mixture between the electrodes of the spark plug, i.e. across the discharging gap of the spark plug (curve a). For example, as shown in FIG. 4, when the sparking voltage has exceeded a reference voltage value Vmis1 for determination of a normal firing, i.e. $V > Vmis1$, dielectric breakdown of the mixture occurs, and then the discharge state shifts from a capacitive discharge state before the dielectric breakdown (early-stage capacitive discharge), which state has a very short duration with several hundreds amperes of current flow, to an inductive discharge state which has a duration of several milliseconds and where the sparking voltage assumes almost a constant value with several tens milliamperes of current flow (curve b). The inductive discharge voltage rises with an increase in the pressure within the engine cylinder caused by the compression stroke of the piston executed after the time point tO, since a higher voltage is required for inductive discharge to occur as the cylinder pressure increases. At the final stage of the inductive discharge, the voltage between the electrodes of the spark plug lowers below a value required for the inductive discharge to continue, due to decreased inductive energy of the ignition coil so that the inductive discharge ceases and again capacitive discharge occurs. In this capacitive discharge state, the voltage between the spark plug electrodes again rises, i.e. in the direction of causing dielectric breakdown of the mixture. However, since the ignition coil 21 then has a small amount of residual energy, the amount of rise of the voltage is small (curve c). This is because the electrical resistance of the discharging gap is low due to ionizing of the mixture during firing.

Next, reference is made to a sparking voltage characteristic indicated by the broken line, which is obtained when a misfire attributable to the fuel supply system (hereinafter referred to as "FI misfire") occurs, which is caused by the supply of a lean mixture to the engine or cutting-off of the fuel supply to the engine due to failure of the fuel supply system, etc. Immediately after the time point tO of generation of the ignition command signal A, the sparking voltage rises above a level causing dielectric breakdown of the mixture. In this case, the ratio of air in the mixture is greater than when the mixture has an air-fuel ratio close to a stoichiometric ratio, and accordingly the dielectric strength of the mixture is high. Besides, since the mixture is not fired, it is not ionized so that the electrical resistance of the discharging gap of the plug is high. Consequently, the dielectric breakdown voltage becomes higher than that obtained in the case of normal firing of the mixture (curve a'), as shown in FIG. 4.

Thereafter, the discharge state shifts to an inductive discharge state, as in the case of normal firing (curve b'). Also, the electrical resistance of the discharging gap of the plug at the discharge of the ignition coil is greater in the case of supply of a lean mixture, etc. than that in the case of normal firing so that the inductive discharge voltage rises to a higher level than at normal firing, resulting in an earlier shifting from the inductive discharge state to a capacitive discharge state (late-stage capacitive discharge). The capacitive discharge voltage upon the transition from the inductive discharge state to the capacitive discharge state is by far higher than that at normal firing (curve c'), because the voltage of dielectric breakdown of the mixture is higher than that at normal firing, and also because the ignition coil still has a considerable amount of residual energy due to the earlier termination of the inductive discharge (i.e. the discharge duration is shorter). Therefore, immediately after this late-stage capacitive discharge, the sparking voltage drastically drops to approx. zero voltage, because the residual energy of the ignition coil drastically decreases.

As shown in FIGS. 4 and 6, the sparking voltage (secondary voltage) generated by the secondary coil 21*b* of the ignition coil 21 presents almost identical characteristics with those described above with respect to the sparking voltage (primary voltage) generated by the primary coil 21*a* of the ignition coil 21. Therefore, description of the secondary voltage characteristics is omitted.

Figure 3:
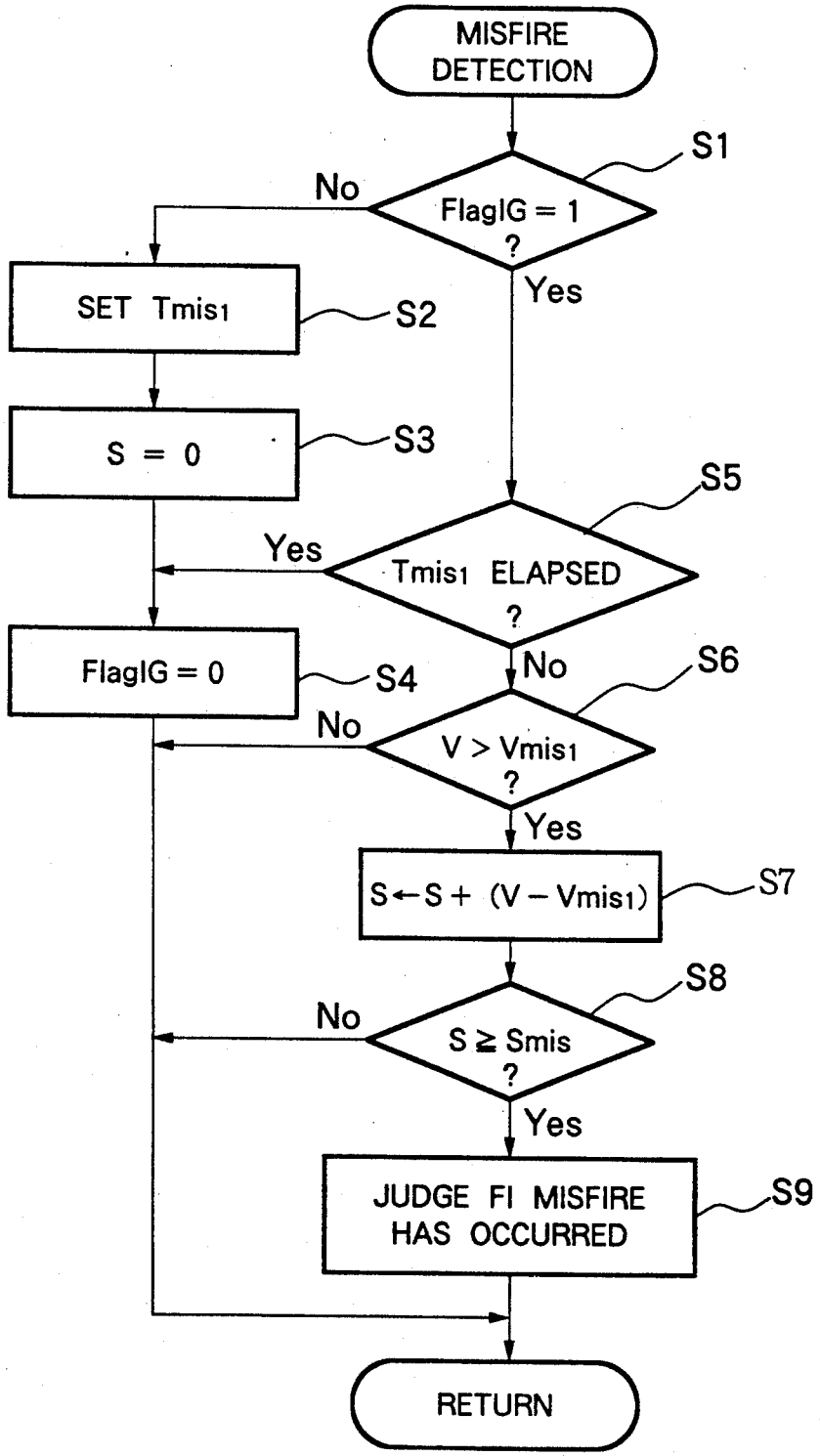
FIG. 3 is a flowchart showing a program for detecting a misfire attributable to the fuel supply system, based upon the primary voltage (sparking voltage) of an ignition coil in FIG. 1, according to the first embodiment.

Next, the operation of the misfire-detecting circuit of FIG. 2 based upon the primary voltage of the ignition coil 21 will be explained with reference to FIGS. 3 and 4. FIG. 3 shows a program for detecting a misfire attributable to the fuel supply system by means of the FIG. 2 circuit. This program is executed at predetermined fixed time intervals.

First, it is determined at a step S1 whether or not a flag IG, which is indicative of whether or not the ignition command signal A has been generated, has been set to a value of 1. The flag IG indicates, when set to 1, that the signal A has been generated. The flag IG is thus set to 1 upon generation of the signal, and reset to 0 upon lapse of a predetermined time period. When the ignition command signal A has not been generated, the answer to the question of the step S1 is negative (No), and then the program proceeds to steps S2 S3 and S4, where a timer within the ECU 5, which measures time elapsed after generation of the ignition command signal A, is set to a predetermined time period Tmis1, and started, the value proportional to an area S is initialized to zero and stored in the memory means 5c, and the flag IG is set to 0, followed by terminating the program. The flag IG is set to 1 upon generation of the signal A, by a routine other than the FIG. 3 routine, e.g. an ignition timing-calculating routine.

The predetermined time period Tmis1 is set at a time period slightly longer than a time period from the time of generation of the ignition command signal A to the time of generation of the late-stage capacitive discharge, assumed when a normal firing occurs. The time period Tmis1, as well as predetermined values Vmis1 and Smis hereinafter referred to, are each read from a map or a table in accordance with operating conditions of the engine 1.

When the ignition command signal A has been generated and hence the flag IG has been set to 1, the program proceeds from the step S1 to a step S5 to determine whether or not the predetermined time period Tmis1, counted by the timer within the ECU5, has elapsed (see FIG. 4). Immediately after generation of the ignition command signal A, the predetermined time period Tmis1 has not elapsed, so that the program proceeds to a step S6 to determine whether or not the sparking voltage V has exceeded the reference voltage value Vmis1 (see FIG. 4). The reference voltage value Vmis1 is set to a value which the sparking voltage V in the case of normal firing necessarily exceeds during the early-stage capacitive discharge. If $V \leqq Vmis1$, the program is immediately terminated. If $V > Vmis1$, a value proportional to an area is calculated at a step S7, which is defined by the line indicative of the reference voltage value Vmis1 and a portion of the curve indicative of the sparking voltage which is higher than the value Vmis1. The value proportional to this area is added to the value proportional to the area S stored in the memory means 5c to obtain a new value proportional to the area S. Then, it is determined at a step 8 whether or not the new value proportional to the area S exceeds a predetermined value Smis. If the former exceeds the latter, it is determined at a step S9 that an FI misfire has occurred, whereas if the former does not exceed the latter, the program is terminated, determining that no FI misfire has occurred. The above procedure is repeatedly carried out until the predetermined time period Tmis1, counted by the timer, elapses (step S5). The predetermined value Smis is set to a value which is smaller than a value proportional to the area S which can be obtained by addition when an FI misfire occurs.

Values proportional to the area S are exemplified in FIG. 4. In the figure, an area S1 hatched by lines falling rightward shows a value proportional to the area S in the case of a normal firing, while the sum of areas S2 and S3 shows a value proportional to the area S in the case proportional to an FI misfire. The value of the area S in the case proportional to an FI misfire is much larger than a value proportional to the area S in the case a normal firing, so that the former exceeds the predetermined value Smis without fail.

In addition, in FIG. 4, values proportional to the areas S1 and S2 are calculated during the early-stage capacitive discharge, and the value proportional to area S3 is calculated during the late-stage capacitive discharge. In the program of FIG. 3, the area S means the area S1 alone on the sum of the areas S2 and S3.

Figure 5:
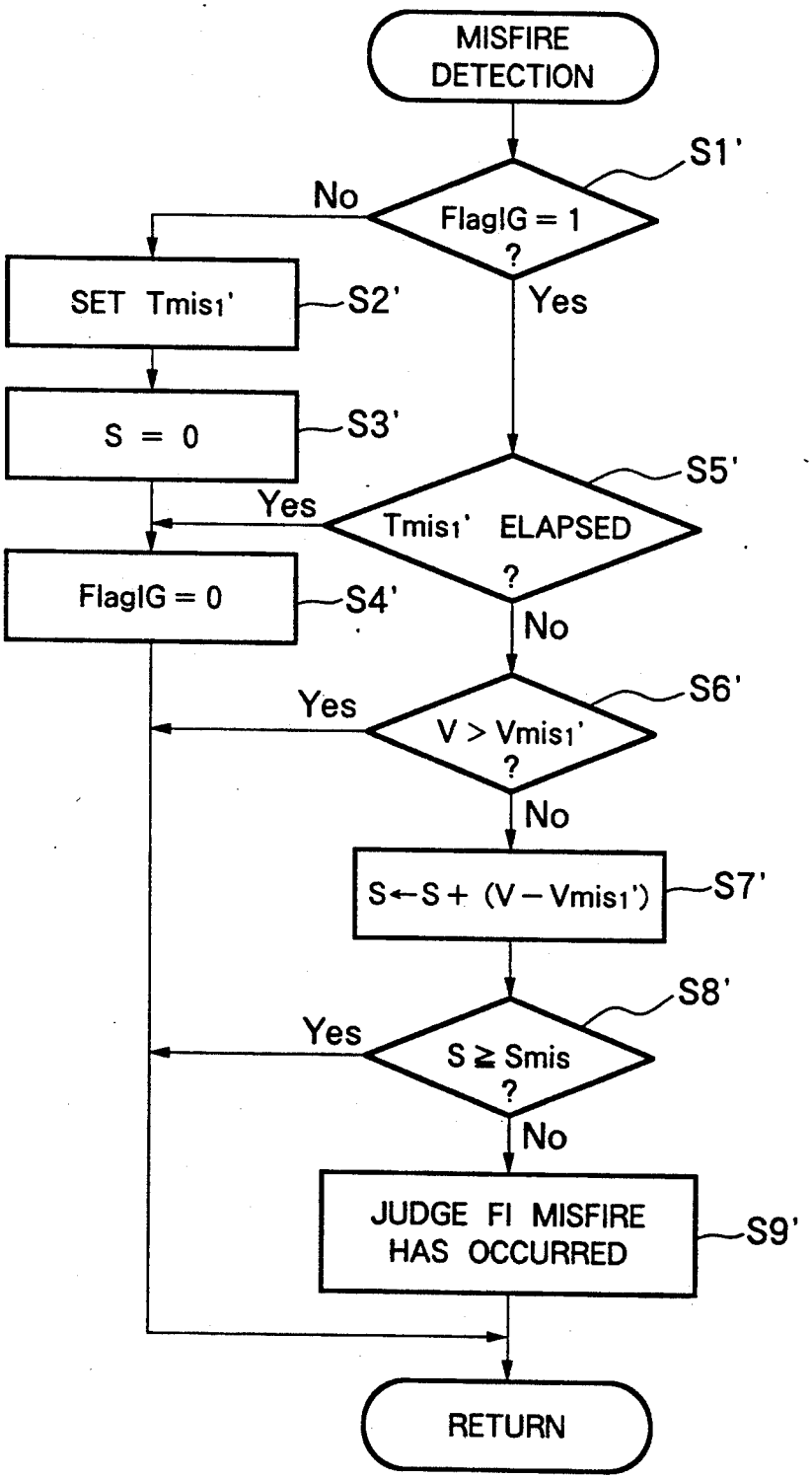
FIG. 5 is a flowchart showing a program for detecting a misfire attributable to the fuel supply system, based upon the secondary voltage (sparking voltage) of the ignition coil, according to a second embodiment of the invention.

Next, reference is made to FIGS. 5 and 6 showing a manner of detecting an FI misfire according to a second embodiment of the invention, which detects an FI misfire based upon the secondary voltage of the ignition coil, by means of the misfire-detecting system according to the invention. In FIGS. 5 and 6, a predetermined time period Tmis1', a reference voltage value Vmis1', and areas S1', S2' and S3' correspond, respectively, to Tmis1, Vmis1, and S1, S2 and S3 in FIGS. 3 and 4. The operation shown in FIG. 5 is the same with the operation shown in FIG. 3 described above, and therefore description thereof is omitted. The values Tmis1 and Tmis1' may be either equal to each other or different from each other. The reference voltage value Vmis1 is usually set to a smaller value than Vmis1'.

In the above described manner, according to the first and second embodiments of the invention, the kind of a misfire, i.e. the occurrence of an FI misfire can be accurately determined, thereby making it possible to determine the faulty place at an early time and take an appropriate fail-safe action.

Figure 7:
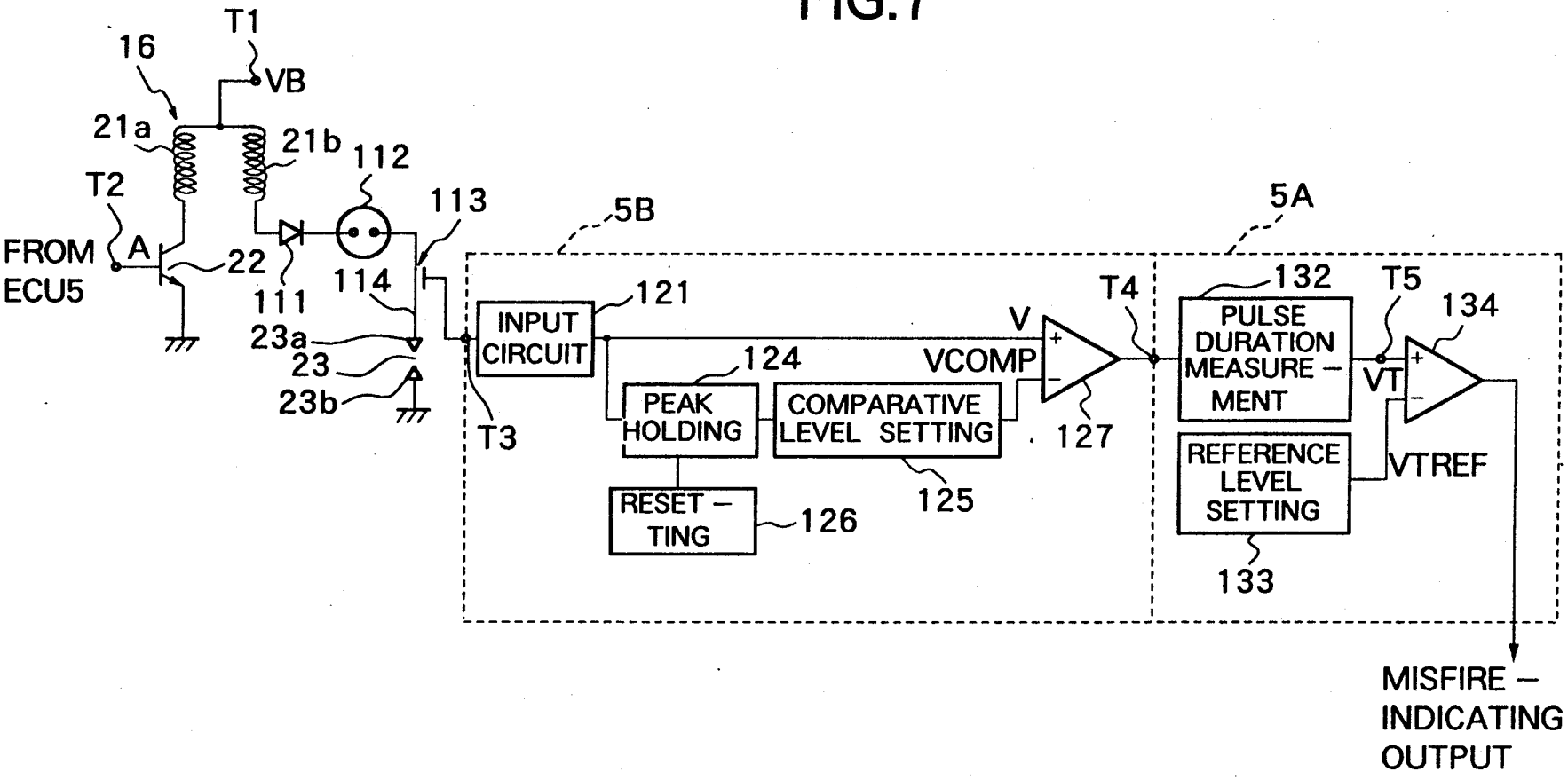
FIG. 7 is a circuit diagram showing the arrangement of a misfire-detecting system according to a third embodiment of the invention.

FIG. 7 shows the arrangement of a misfire-detecting system according to a third embodiment of the invention. In FIG. 7, corresponding elements or parts to those in FIGS. 1 and 2 are designated by identical reference numerals or characters.

A primary coil 21a of an ignition coil 21 is connected to a transistor 22 in the same manner as in the first embodiment of FIG. 2. A secondary coil 21b of the ignition coil 21 is connected to an anode of a diode 111 which has its cathode connected to a center electrode 23a of a spark plug 23 via a distributor 112. Arranged opposite a line 114 connecting between the distributor 112 and the center electrode 23a is a voltage sensor 113 electrostatically coupled to the line 114 and forming a capacitor having a capacitance of several pF together with the line 114. The voltage sensor 113 has its output connected to an input of a peak-holding circuit 124 as well as to a non-inverting input terminal of a first comparator 127 via an input terminal T3 and an input circuit 121. The peak-holding circuit 124 has its output connected to an inverting input terminal of the first comparator 127 via a comparative level-setting circuit 125. Connected to the peak-holding circuit 124 is a resetting circuit 126 for resetting the held peak value at appropriate timing.

An output from the first comparator 127 is supplied to a pulse duration-measuring circuit 132, which in turn measures a time period over which the output from the first comparator 127 is at a high level, and supplies a voltage VT corresponding to the value of the measured time period to a non-inverting input terminal of a second comparator 134. The second comparator 134 has its inverting input terminal connected to a reference value-setting circuit 133 to be supplied therefrom with a reference voltage VTREF for misfire determination.

When VT>VTREF holds, the second comparator 134 generates a high-level output so that it is determined that an FI misfire has occurred. The reference voltage VTREF is set in dependence on operating conditions of the engine.

The ECU 5 in FIG. 2 is applied also in this embodiment to effect fuel injection control, ignition timing control, etc. A circuit block 5A in FIG. 7 may be formed by a part of the ECU 5. Preferably, a circuit block 5B in FIG. 15 may be formed separately from the ECU 5 and arranged at a location close to the cylinder block of the engine 1.

Figure 8:
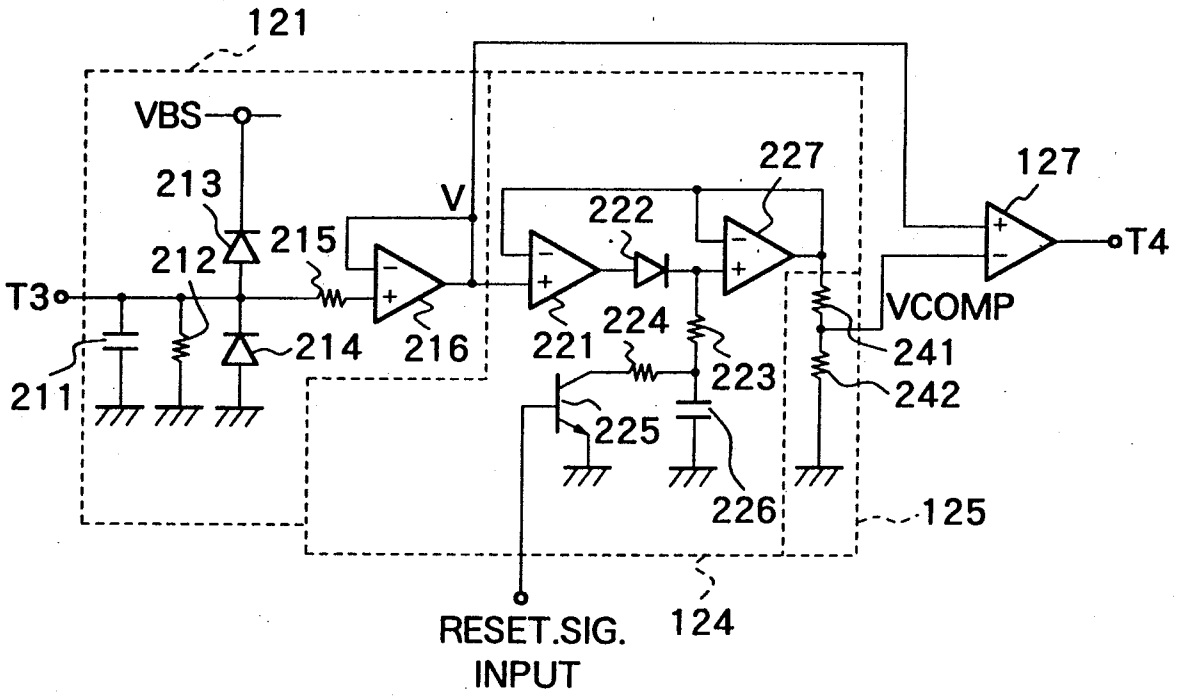
FIG. 8 is a circuit diagram showing details of the construction of part of the system of FIG. 7.

FIG. 8 shows details of the arrangements of the input circuit 121, the peak-holding circuit 124 and the comparative level-setting circuit 125.

In the figure, the input terminal T3 is connected to a non-inverting input terminal of an operational amplifier 216 via a resistance 215. The input terminal T3 is also grounded via a circuit formed of a capacitor 211, a resistance 212, and a diode 214, which are connected in parallel, and connected to a voltage source-feeding line VBS via a diode 213.

The capacitor 211 has a capacitance of $10^4$pF, for example and serves to divide voltage detected by the voltage sensor 13 into one over several thousands. The resistance 212 has a value of 500 KΩ, for example. The diodes 213 and 214 act to control the input voltage to the operational amplifier 216 to a range of 0 to VBS. An inverting input terminal of the operational amplifier 216 is connected to the output of the same so that the operational amplifier 216 operates as a buffer amplifier (impedance converter). The output of the amplifier 216 is connected to the non-inverting input terminal of the first comparator 127 as well as an inverting input terminal of an operational amplifier 221.

The output of the operational amplifier 221 is connected to a non-inverting input terminal of an operational amplifier 227 via a diode 222, with inverting input terminals of the amplifiers 221, 227 both connected to the output of the amplifier 227. These operational amplifiers also form a buffer amplifier.

The non-inverting input terminal of the operational amplifier 227 is grounded via a resistance 223 and a capacitor 226, the junction therebetween being connected to a collector of a transistor 225 via a resistance 224. The transistor 225 has its emitter grounded and its base supplied with a resetting signal from a resetting circuit 126. The resetting signal goes high when resetting is to be made.

The output of the operational amplifier 227 is grounded via resistance 241 and 242 forming a comparative level-setting circuit 125, the junction between the resistances 241, 242 being connected to the inverting input terminal of the first comparator 127.

The circuit of FIG. 8 operates as follows: A peak value of the detected sparking voltage V (output from the operational amplifier 216) is held by the peak-holding circuit 124, the held peak value is multiplied by a predetermined value smaller than 1 by the comparative level-setting circuit 125, and the resulting product is applied to the first comparator 127 as the comparative level VCOMP. Thus, a pulse signal, which goes high when V>VCOMP stands, is supplied through a terminal T4.

Figure 9:
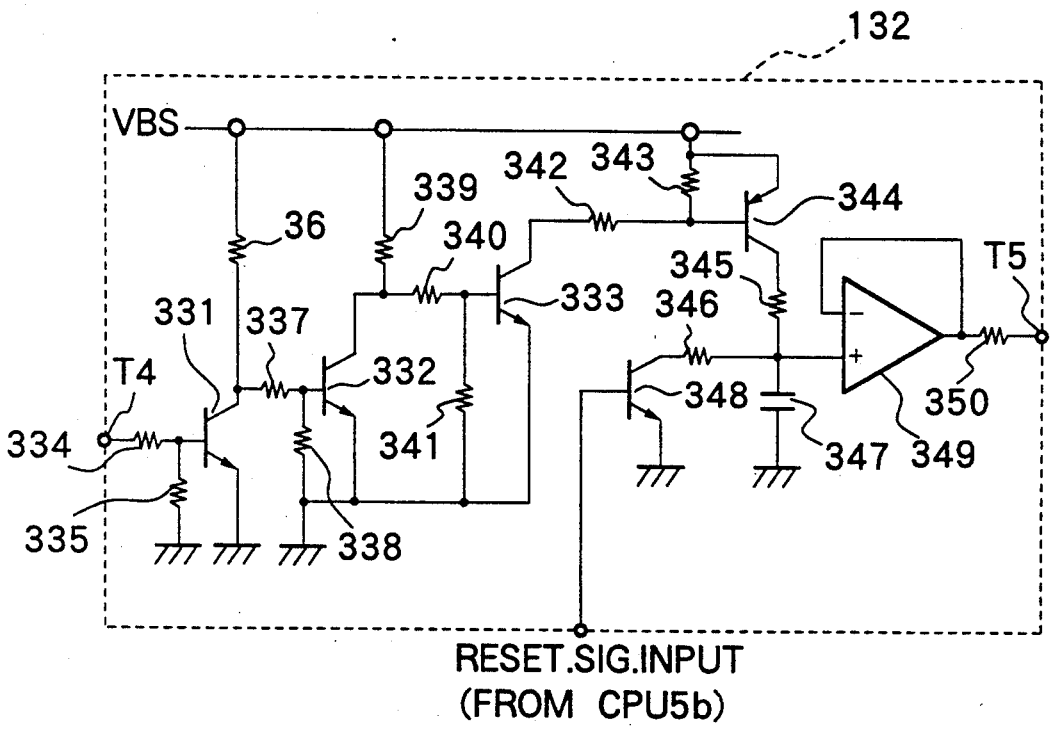
FIG. 9 is a circuit diagram showing details of the construction of another part of the system of FIG. 7.

FIG. 9 shows details of the pulse duration-measuring circuit 132. As shown in the figure, a three-stage inverting circuit is formed by transistors 331–333 and resistances 334–341. Potential at a collector of the transistor 333 becomes low and high respectively as voltage at the terminal T4 becomes high and low level. The collector of the transistor 333 is connected via a resistance 342 to a base of a transistor 344 which base is also connected via a resistance 343 to the power source line VBS, while a collector thereof is grounded via a resistance 345 and a capacitor 347, the junction between which is connected to a terminal T5 via an operational amplifier 349 forming a buffer amplifier and a resistance 350. The junction between the resistance 345 and the capacitor 347 is connected via a resistance 346 to a collector of a transistor 348 with its emitter grounded and its base disposed to be supplied with a resetting signal from the CPU **5*b***.

The circuit of FIG. 9 operates as follows: When the input through the terminal T4 is high, the transistor 333 is conducting so that the transistor 344 is conducting to cause the capacitor 347 to be charged. On the other hand, when the input through the terminal T4 is low, the transistor 344 is deenergized to stop charging of the capacitor 347. Accordingly, the terminal T5 assumes a voltage VT proportional to a time period over which the pulse signal input through the terminal T4 is high.

The operation of the misfire-detecting system constructed as above according to this embodiment will now be explained with reference to a timing chart of FIG. 10. In (b), (c), (d), and (e) of FIG. 10, the solid lines show operation at normal firing, while the broken lines show operation at FI misfire. (a) of FIG. 10 shows an ignition command signal.

Figure 10:
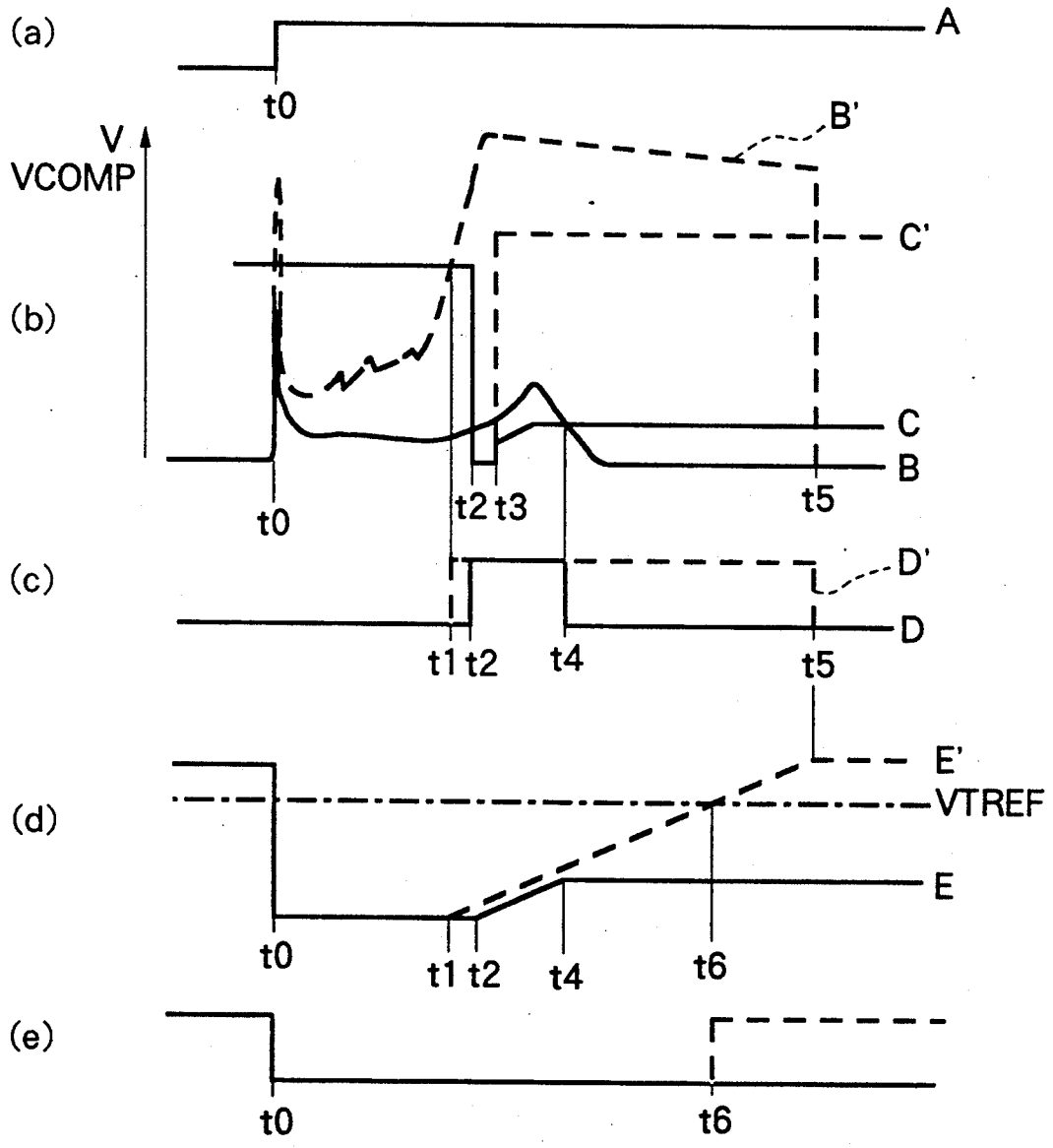
FIGS. 10(*a*)–10(*e*) are timing charts useful in explaining the operation of the system of FIG. 7.

(b) of FIG. 10 show changes in the detected sparking voltage V (B, B′) and the comparative level VCOMP (C, C′) with the lapse of time. The curve B at normal firing changes in a similar manner as in FIG. 4 referred to hereinbefore. The curve B′ at FI misfire presents a different characteristic after the capacitive discharge voltage shows a peak immediately before the termination of the discharge, from that in FIG. 4. This is because the diode 111 is provided between the secondary coil **21*b* and the distributor 112, as shown in FIG. 7**. This will be explained in detail below.

Electric energy generated by the ignition coil 21 is supplied to the spark plug 23 via the diode 111 and the distributor 112 to be discharged between the electrodes of the spark plug 23. Residual charge after the discharge is stored in the floating capacitance between the diode 111 and the spark plug 23. At normal firing, the stored charge is neutralized by ions present in the vicinity of the electrodes of the spark plug 23, so that the sparking voltage V at the termination of the capacitive discharge promptly declines as if the diode 111 were not provided (B in (b) of FIG. 18).

On the other hand, at misfire, almost no ion is present in the vicinity of the electrodes of the spark plug 23 so that the charge stored between the diode 111 and the spark plug 23 is not neutralized, nor is it allowed to flow backward to the ignition coil 21 due to the presence of the diode 111. Therefore, the charge is held as it is without being discharged through the ignition coil 21. Then, when the pressure within the engine cylinder lowers so that the voltage between the electrodes of the spark plug 23 required for discharge to occur becomes equal to the voltage applied by the charge, there occurs a discharge between the electrodes (time point t5 in (b) of FIG. 10). Thus, due to the action of the diode 111, even after the termination of the capacitive discharge, the sparking voltage V is maintained in a high state over a longer time period than at normal firing.

The curves C, C' in (b) of FIG. 10 show changes in the comparative level VCOMP with the lapse of time, obtained from the held peak value of the sparking voltage V. The peak-holding circuit 124 is resetted during time point t2 and t3. Therefore, the curves before the time point t2 show the comparative level VCOMP obtained from the last cylinder which was subjected to ignition. (c) of FIG. 10 shows outputs from the first comparator 127. As is clear from (b) and (c) of FIG. 10, at normal firing, V>VCOMP holds between time points t2 and t4, whereas at misfire, V>VCOMP holds between time points t1 and t5, and during each of the durations, the output from the first comparator 127 has a high level. As a result, the output voltage VT from the pulse duration-measuring circuit 132 changes as shown in (d) of FIG. 10, such that at misfire (in which VT is indicated by a curve E'), VT>VTREF holds after a time point t6. Accordingly, the output (misfire-determining output) from the second comparator 134 goes high after the time point t6 as shown in (e) of FIG. 10 whereby an FI misfire is detected.

In addition, the pulse duration-measuring circuit 132 is reset at the time point t0.

According to this embodiment, the comparative level VCOMP is set based on the detected sparking voltage, which enables to stably detect an FI misfire without being affected by fluctuations in the actual sparking voltage or the detected sparking voltage. Further, the provision of the diode 111 serves to show, in a magnifying manner, a difference between the time period over which the sparking voltage exceeds the comparative level at normal firing and the time period over which the former exceeds the latter at misfire, which enables to perform an accurate misfire detection.

Figure 11:
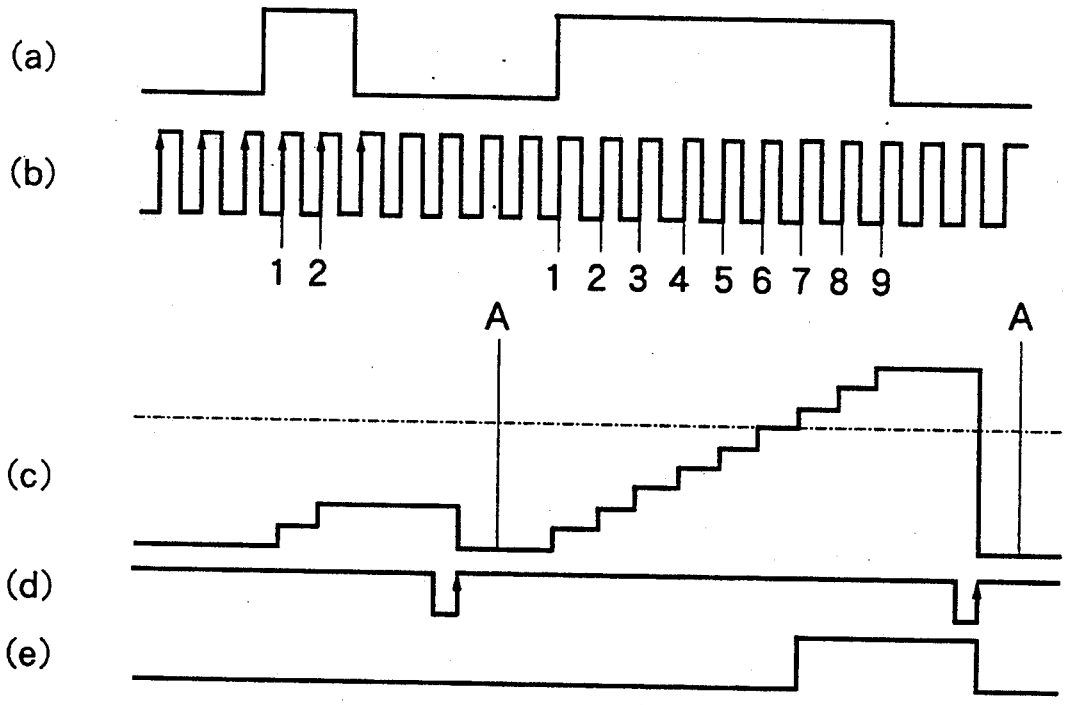
FIGS. 11(*a*)–11(*e*) are timing charts useful in explaining the operation of the system of FIG. 7.

The pulse duration-measuring circuit 132 may also be formed by a digital counter. FIG. 11 shows a timing chart for explaining the operation of the circuit 132 constructed as such. (a) of FIG. 11 shows output pulses from the first comparator 127. (b) of same shows clock pulses, the number of which is counted by the digital counter while each pulse appearing in (a) of same is at a high level. The count value changes as shown in (c) of same. In this example, the counter is reset immediately before the ignition command signal A, as shown in (d) of same. When the count value exceeds a predetermined value, a pulse indicative of detection of misfire is output, as shown in (e) of same.

Figure 12:
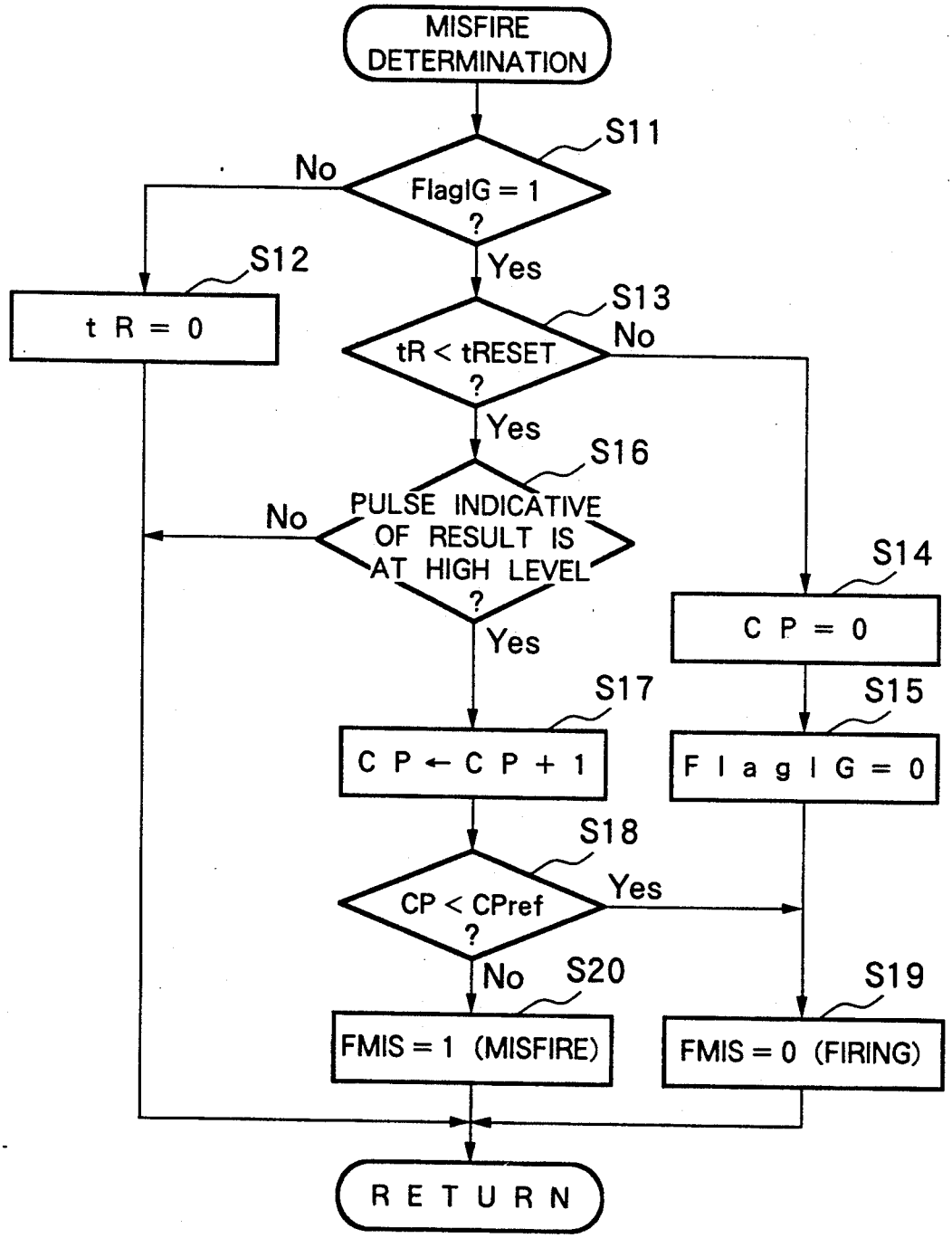
FIG. 12 is a flowchart showing a program for determining a misfire, according to a fourth embodiment of the invention.

Further, according to a fourth embodiment of the invention, the functions of the pulse duration-measuring circuit 132, the reference value-setting circuit 133, and the second comparator 134 may be realized in a software manner by the CPU **5*b* of the ECU 5. FIG. 12 shows a program executed by the CPU 5*b*** for detecting misfire. This program is carried out whenever a predetermined fixed time period elapses.

First at a step S11, it is determined whether or not the flag IG is equal to 1. If the answer to this question is negative (No), i.e. if the flag IG is equal to 0, a measured time value of a resetting timer is set to 0 at a step S12, followed by terminating the program. If the answer to the question of the step S11 is affirmative (Yes), i.e. if the flag IG is equal to 1, it is determined at a step S13 whether or not the value tR of the resetting timer is smaller than a predetermined value tRESET. Immediately after the flag IG has been changed from 0 to 1, the answer to this question is affirmative (Yes), and then at a step S16, it is determined whether or not an output pulse from the first comparator 127, i.e. a high-level pulse indicative of the result of the determination by voltage comparison, is being supplied to the CPU **5*b*. If the answer to this question is affirmative (Yes), the count value CP of a counter is increased by an increment of 1 at a step S17, and then it is determined at a step S18** whether or not the resulting count value CP is smaller than a predetermined value CPref.

If the answer to the question of the step S18 is affirmative (Yes), i.e. if CP<CPref, it is determined that a normal firing has occurred, and a flag FMIS is set to 0 at a step S19, whereas if the answer is negative (No), i.e. if CP≧CPref, it is determined that an FI misfire has occurred, and the flag FMIS is set to 1 at a step S20, followed by terminating the program.

If the answer to the question of the step S13 becomes negative (No), i.e. tR>tRESET, the count value CP and the flag IG are reset to 0 at respective steps S14 and S15, followed by the program proceeding to the step S19.

According to the program of FIG. 12, the count value CP of the counter corresponds to the duration of the pulse indicative of the result of the determination by voltage comparison, i.e. the high-level output pulse from the first comparator 127, and when the duration exceeds the predetermined time period (CPref), it is determined that there has occurred an FI misfire.

Next, the characteristics of the diode 111 used in the embodiment shown in FIG. 7 will be discussed.

Figure 13A:
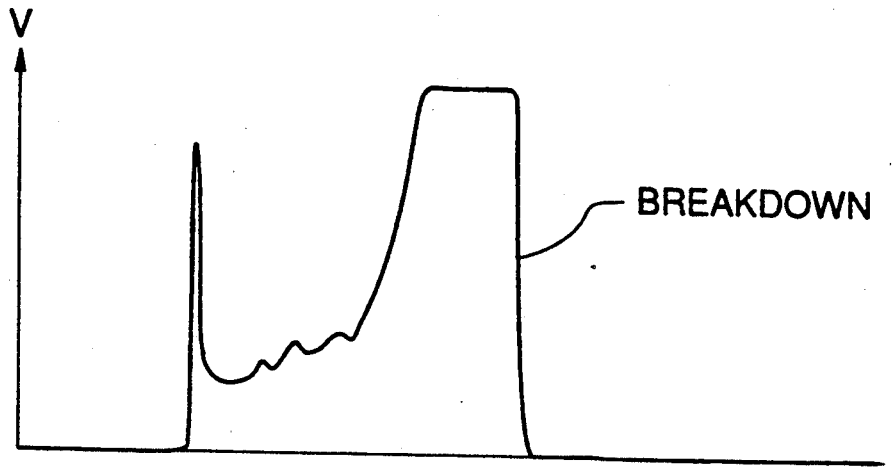
FIGS. 13(*a*)–13(*b*) are timing charts showing waveforms of sparking voltage.
Figure 13B:
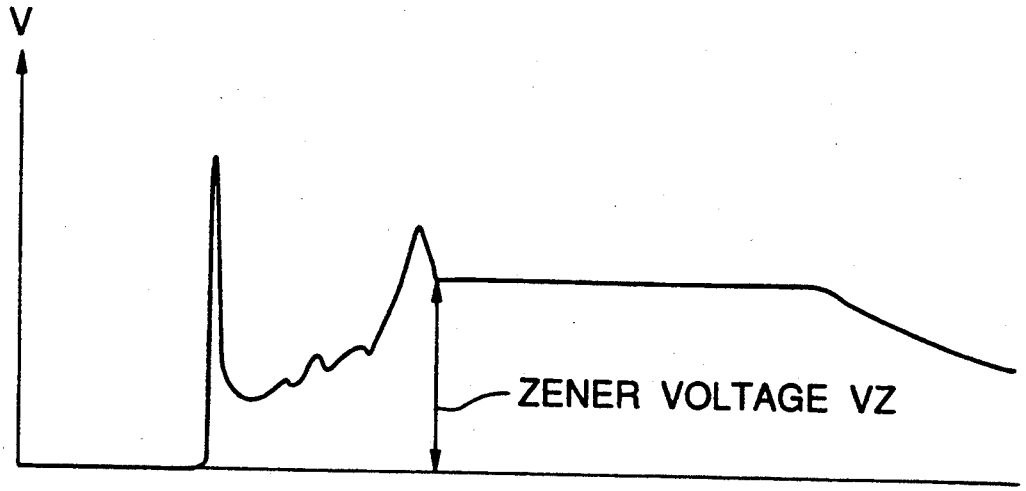

If the diode 111 has too high a reverse withstand voltage (avalanche voltage), when a large floating capacitance is present between the diode 111 and the spark plug 23 (i.e. voltage across the discharging gap of the spark plug is high), dielectric breakdown occurs between the electrodes of the spark plug 23 immediately after the pressure within the engine cylinder falls after the piston passes the top dead center so that the sparking voltage V promptly drops without being held at a high voltage ((a) in FIG. 13). A drop in the sparking voltage V caused by such dielectric breakdown cannot be discriminated from a drop in the sparking voltage V caused by ion current at normal firing, making it impossible to effect misfire detection.

To eliminate this inconvenience, a Zener diode having a Zener voltage VZ of the order not causing dielectric breakdown between the spark plug electrodes (5–10 KV) may be used as the diode 111. In this case, at misfire, the detected sparking voltage V can be maintained in the vicinity of the Zener voltage VZ over a long time period, as shown in (b) of FIG. 13, making it possible to effect misfire detection.

If a diode having a moderately low reverse withstand voltage is used as the diode 111, similar results to the above-mentioned results obtained by a Zener diode can be obtained. However, such a diode should be one which can exhibit its proper function when the voltage applied thereto becomes lower to a normal operating range not exceeding the reverse withstand voltage.

Figure 14:
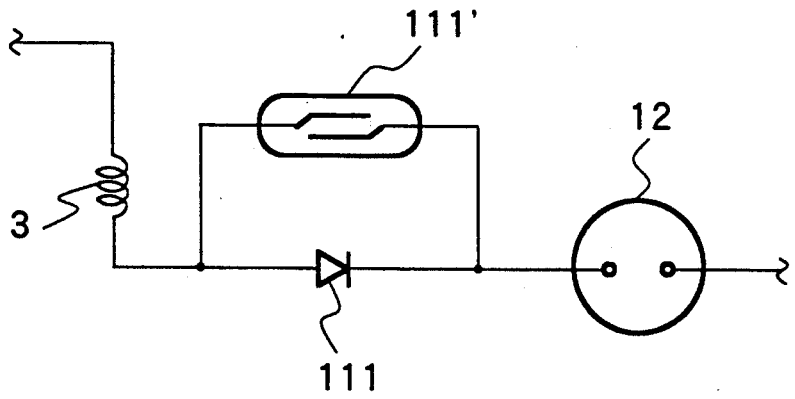
FIG. 14 is a fragmentary circuit diagram showing a variation of the FIG. 7 system.

Further, as shown in FIG. 14, a gap element 111' may be connected in parallel with a diode 111 having too high a reverse withstand voltage. The gap element 111' should have a stable dielectric breakdown voltage of the order of 5–10 KV. Even with this arrangement, a sparking voltage characteristic similar to one shown in (b) of FIG. 13 may be obtained at misfire.

Further, as the smoothing means, an averaging circuit (integrating circuit) may be used instead of the peak-holding circuit 124 in FIG. 7.

In the third and fourth embodiments described above, an area defined by the line indicative of the comparative level VCOMP and a portion of the curve indicative of the detected sparking voltage V which is higher than the comparative level VCOMP (i.e. a value obtained by integrating (V−VCOMP)) may be calculated to detect misfire in a manner similar to the first embodiment. Further, the third or fourth embodiment may be combined with the first or second embodiment to thereby determine occurrence of misfire only when the results obtained by the two embodiments both indicate occurrence of misfire.

As described in detail heretofore, according to the invention, a misfire in an internal combustion engine is determined from a time period over which the sparking voltage exceeds a predetermined voltage value and/or a value proportional to an area of a portion of the sparking voltage which exceed the predetermined voltage value. Therefore, it is possible to accurately detect a misfire attributable to the fuel supply system (FI misfire), and hence determine the faulty place at an early time and take an appropriate fail-safe action.

Further, the predetermined voltage value is set in dependence on operating conditions of the engine or on the sparking voltage. Therefore, it is possible to accurately detect a misfire even if the operating condition of the engine changes.

Still further, current-checking means arranged in the secondary circuit of the igniting means checks a flow of current in a reverse direction to a direction in which a current flow occurs at discharge of the spark plug. Therefore, when a misfire occurs, the voltage in the secondary circuit can be maintained at a high level over a long time period and hence the occurrence of misfire can be determined more accurately.

What is claimed is:

1. A misfire-detecting system for detecting a misfire occurring in an internal combustion engine having an ignition system including at least one spark plug, engine operating condition-detecting means for detecting values of operating parameters of said engine, signal-generating means for determining ignition timing of said engine, based upon the detected values of said operating parameters of said engine and for generating an ignition command signal indicative of the determined ignition timing, and igniting means responsive to said ignition command signal for generating sparking voltage for discharging said at least one spark plug, said misfire-detecting system comprising:

voltage value-detecting means for detecting a value of said sparking voltage generated by said igniting means after generation of said ignition command signal; and misfire-determining means for comparing the detected value of said sparking voltage with a predetermined voltage value, and for determining whether or not a misfire has occurred in said engine, based upon results of said comparison;

said misfire-determining means effects said determination as to occurrence of said misfire, based upon at least one of a) a time period dependent upon an amount by which the detected value of said sparking voltage exceeds said predetermined voltage value, and b) a value proportional to an area of a portion of detected values of said sparking voltage exceeding said predetermined voltage value.

2. A misfire-detecting system as claimed in claim 1, wherein said predetermined voltage value is set in dependence on operating conditions of said engine.

3. A misfire-detecting system as claimed in claim 1, wherein said misfire-determining means includes reference level-setting means which sets said predetermined voltage value based upon the detected value of said sparking voltage.

4. A misfire-detecting system as claimed in claim 3, wherein said reference level-setting means comprises smoothing means for smoothing said sparking voltage, and amplifier means for amplifying an output from said smoothing means by a predetermined amplification factor.

5. A misfire-detecting system as claimed in any of claims 1, 3, and 4, wherein said igniting means has a primary circuit and a secondary circuit, said misfire-detecting system including current-checking means arranged in said secondary circuit for checking a flow of current in a reverse direction to a direction in which a current flow occurs at discharge of said at least one spark plug.

6. A misfire-detecting system as claim in any of claims 1–4, wherein said ignition coil comprises a primary coil and a secondary coil, said sparking voltage being primary voltage generated by said primary coil.

7. A misfire-detecting system as claimed in any of claims 1–4, wherein said ignition coil comprises a primary coil and a secondary coil, said sparking voltage being secondary voltage generated by said secondary coil.

8. A misfire-detecting system as claimed in any of claims 1–4, wherein said engine has a fuel supply system, said misfire being attributable to said fuel supply system.

* * * * *